United States Patent [19]

Plumpton

[11] 4,069,676

[45] Jan. 24, 1978

[54] MINE PACKING EQUIPMENT

[75] Inventor: Norman Albert Plumpton, Burton-on-Trent, England

[73] Assignee: Coal Industry (Patents) Ltd., London, England

[21] Appl. No.: 698,365

[22] Filed: June 22, 1976

[30] Foreign Application Priority Data

July 11, 1975 United Kingdom ..... 29220/75

[51] Int. Cl.[2] ..... E02D 15/00

[52] U.S. Cl. ..... 61/35; 61/45 D

[58] Field of Search ..... 61/45 D, 35, 41 R, 63, 61/45 R, 84, 85; 299/31-33; 91/170 MP

[56] References Cited

U.S. PATENT DOCUMENTS

| | | | |
|---|---|---|---|
| 3,791,155 | 2/1974 | Lockwood | 61/45 D |
| 3,831,384 | 8/1974 | Kempster | 61/35 |
| 3,872,677 | 3/1975 | Linke et al. | 61/45 D |
| 3,943,723 | 3/1976 | Evans et al. | 61/45 D |

*Primary Examiner*—Dennis L. Taylor

*Attorney, Agent, or Firm*—James C. Wray

[57] ABSTRACT

Equipment for retaining flowable material within a packhole has two connected sections defining two boundaries of the packhole. The sections comprise a base and a roof engaging assembly for engaging the mine roof. Each section has a flexible sheet connected to the base and roof assembly.

7 Claims, 4 Drawing Figures

MINE PACKING EQUIPMENT

This invention relates to mine packing equipment and in particular to shuttering for retaining flowable packing material within packholes.

An object of the present invention is to provide improved shuttering for retaining flowable packing material within a packhole which is efficient, portable and robust.

According to the present invention mine packing equipment for retaining flowable packing material within a packhole comprises two connected sections for defining at least two boundaries of the packhole, each section including a base, a roof engaging assembly for engaging the mine roof, a telescopic guide arrangement intermediate the base and the roof engaging assembly, a piston and cylinder device for controlling movement of the telescopic guide arrangement, and a flexible sheet interconnected along its upper and lower edges to the roof engaging assembly and the base, respectively.

Preferably, the two sections are pivotally connected to one another.

Conveniently, the two sections are pivotably connected to one another by pivot means mounted on the bases and on the roof engaging assemblies of the two sections.

Advantageously, each sheet is supported by vertically spaced horizontal members mounted on the associated telescopic guide arrangement.

Preferably, adjacent spaced horizontal members are interconnected by chains.

Advantageously, bracket devices are provided for attaching the packing equipment to both the base and roof beams of adjacent roof supports.

By way of example only, one embodiment of the present invention will be described with reference to the accompanying drawings, in which.

Figure 1:
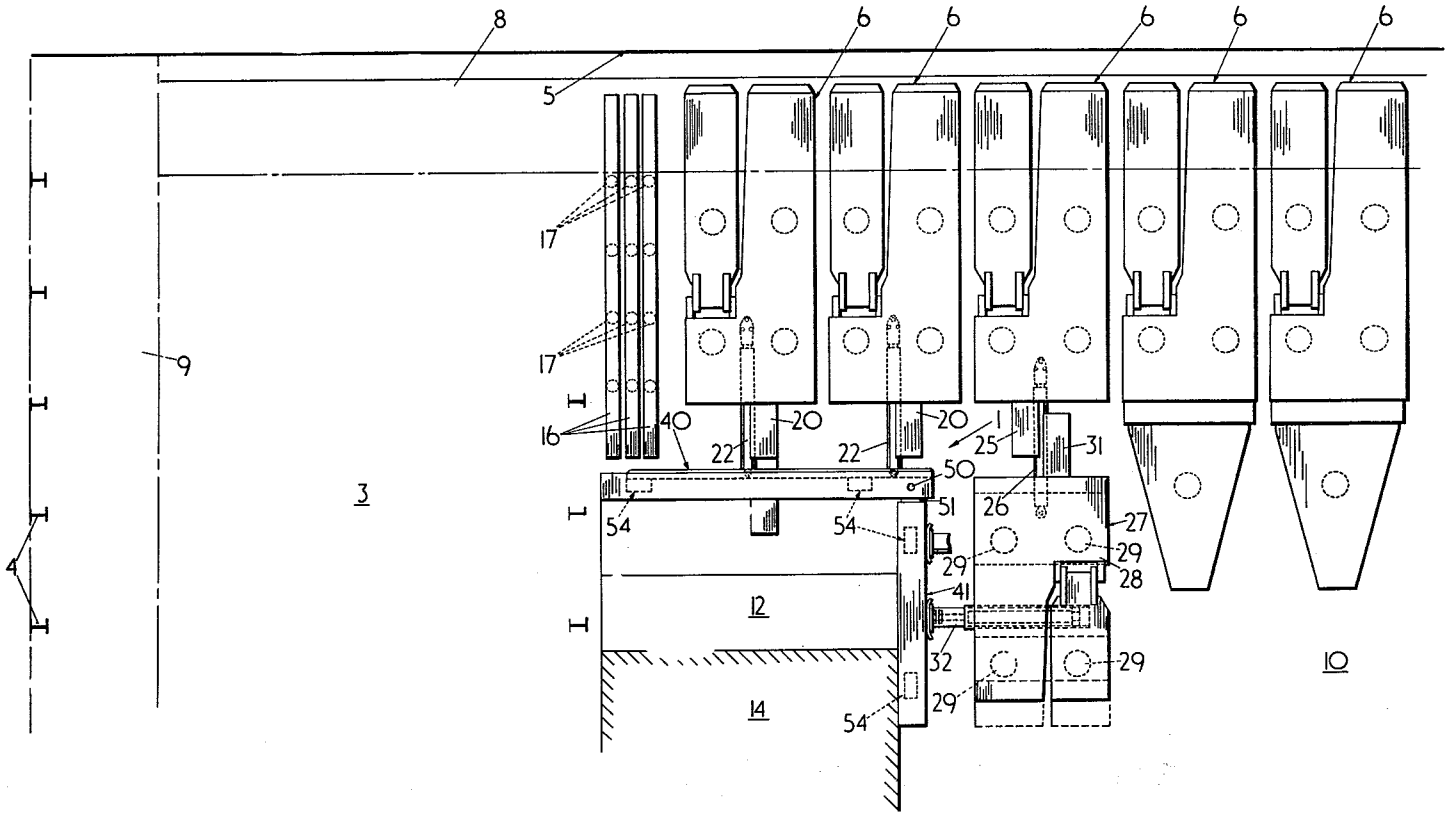
FIG. 1 is a plan of mine packing equipment constructed in accordance with the present invention and shown in an operational position.

Referring to FIG. 1, the mine pack equipment 1 is shown in an operational position situated adjacent to an underground mine roadway 3 (only a part of which is shown) supported by arch roof supports 4 and leading to a longwall coal face 5 (only a part of which is shown) supported by a series of self advancing roof supports 6 arranged along the face. In operation, coal is won from the longwall working face by a winning machine (not shown) traversing to and fro along an armoured face conveyor 8 arranged to convey cut coal along the face onto a stage loader conveyor 9 extending along the roadway. As the coal is excavated the roof supports 6 are advanced in series leaving a goaf 10 behind, the goaf being left unsupported and allowed to collapse or cave except for packholes 12 (only one of which is shown) for the formation of packs 14 which are built at each end of the face to protect the roadway from excessive strata forces.

The mine roof of the longwall face immediately adjacent to the roadway is supported by three parallel roof engaging beams 16 carried on a number of hydraulic props 17. Each of the first two roof supports 6 is equipped with a rearwardly directed beam 20 which can be slid longitudinally relative to the remainder of the roof support under the action of a ram (not shown) and which carries a pivot bracket device 21 (see FIG. 4) for attachment to the packing equipment as described later in this specification. The said first two roof supports are also connected to the packing equipment by generally horizontal double acting hydraulic rams 22.

Figure 2:
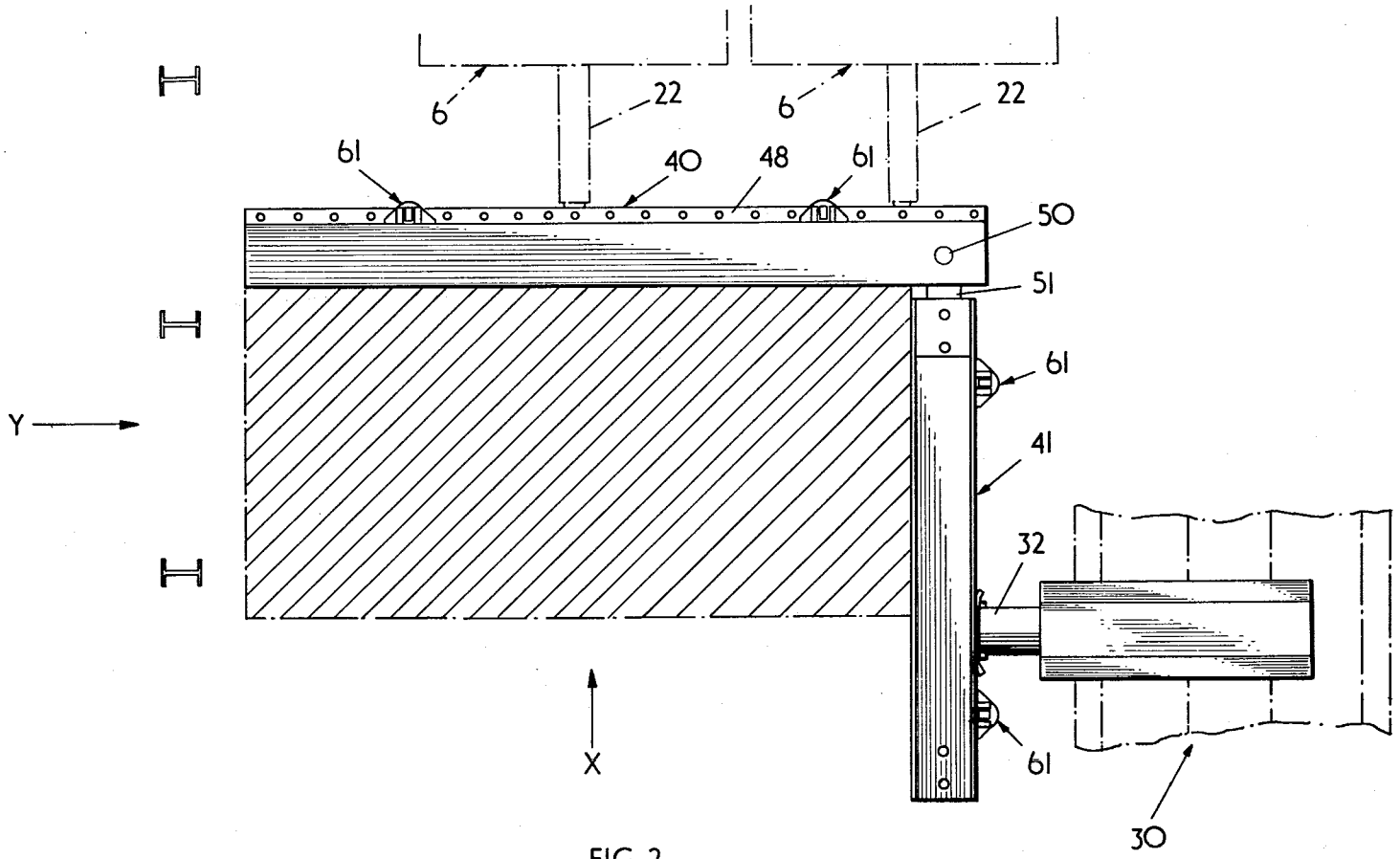
FIG. 2 is a plan of the equipment of FIG. 1 shown on a slightly larger scale.
Figure 3:
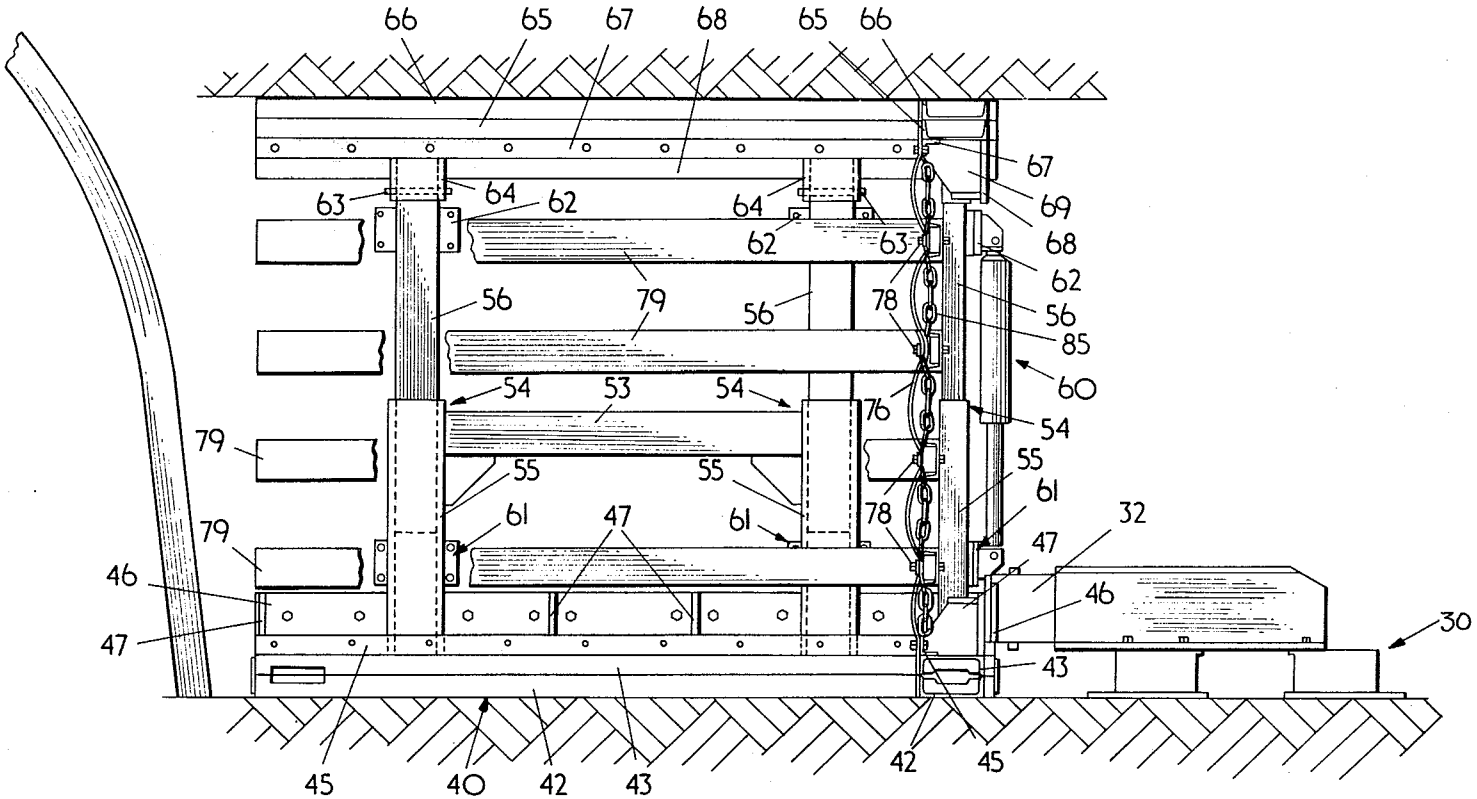
FIG. 3 is an incomplete side view of FIG. 2 looking in the direction of arrow X.

The third roof support along the face also comprises a rearwardly directed roof engaging beam 25 and a generally horizontal hydraulic ram 26 which is connected to an anchor chock 27 comprising a roof engaging canopy 28 supported on four hydraulic props 29 mounted on a base assembly 30 (see FIGS. 2 and 3) to which the rear end of the ram 26 is pivotally attached. A roof engaging beam 31 extends forwardly from the canopy 28 towards the associated roof support 6.

A further generally horizontal ram 32 extends from the base assembly 30 to releasably abut the packing equipment.

The packing equipment is constituted by shuttering for retaining flowable packing material within the packhole 12 until a solid pack 14 is formed. The flowable packing material comprises, for example, broken coal and/or rock which is formed into a sludge by the addition of water and other substances for example, bentonite, and which is pumped along a pipe line (not shown) extending along the roadway. Before the flowable packing material is fed into the packhole 12 via an inlet hole (not shown) formed in the upper part of the shuttering a setting agent for example, quick setting cement, is added to the sludge so that once the pack 14 is built it rapidly sets to provide support to protect the roadway.

As can be seen in FIGS. 1 to 4, the shuttering comprises two pivotally connected sections 40 and 41 of similar construction to one another and arranged to define two boundaries of the packhole 12. The rear side of the packhole is constituted by the previously formed pack 14, and the side adjacent to the roadway is formed by a wall built of, for example, bags containing rock packing material, the wall of bags being omitted from the drawings.

Each section 40, 41 of the shuttering comprises a base formed by two trough-sectioned beams 42, 43 secured together to form a box-sectioned beam, a small inwardly directed angle bracket 45 secured to the upper beam 43 and a large outwardly directed upright plate 46 secured to the upper beam and supported by gussets 47. The upright plate 46 of the section 40 has a pivotal connector bracket 48 (see FIGS. 2 and 4) for attachment of the previously mentioned rams 22 extending from the two associated roof supports 6. The upright plate 46 of the section 41 is abutted by the ram 32 on the anchor chock 27. The adjacent ends of the two bases are pivotally linked by a pivot pin 50 (see FIGS. 2 and 4) engaging the box-sectioned beam 42, 43 of section 40 and a connecting link 51 secured to the box-sectioned base 42, 43 of section 41.

Telescopic guide arrangements 54 extending upwards from each of the box-sectioned beams 42, 43 each comprises a lower box-sectioned member 55 which is fixedly secured to the associated box-sectioned beam and within which a slide member 56 can freely slide. The lower box-sectioned members 55 on each section 40 or 41 are linked by a crossbeam 53. Relative longitudinal sliding movement of each of the slide members and its associated box-sectioned member is controlled by a piston and cylinder arrangement 60 attached to brackets 61, 62 fixed on the slide member and the box-sectioned member respectively.

The upper end of each of the slide members 56 is loosely attached by a cross pin 63 to an upper box-sectioned member 64 secured to the lower surface of the lowest of two inverted trough-sectioned beams 65, 66, the upper one of which engages the mine roof and may be provided with resilient sealing material (not shown) for contacting the mine roof.

A small inwardly directed angle-sectioned bracket 67 is provided on each section 40, 41 and a large outwardly directed upright plate 68 having gussets 69 and secured to the lower surface of the beam 65 of section 41.

The two adjacent ends of the two roof engaging beams of the two sections 40, 41 are pivotally connected via a pivot assembly similar to that provided between the two bases and comprising a pivot pin 50 and connecting link 51.

Figure 4:
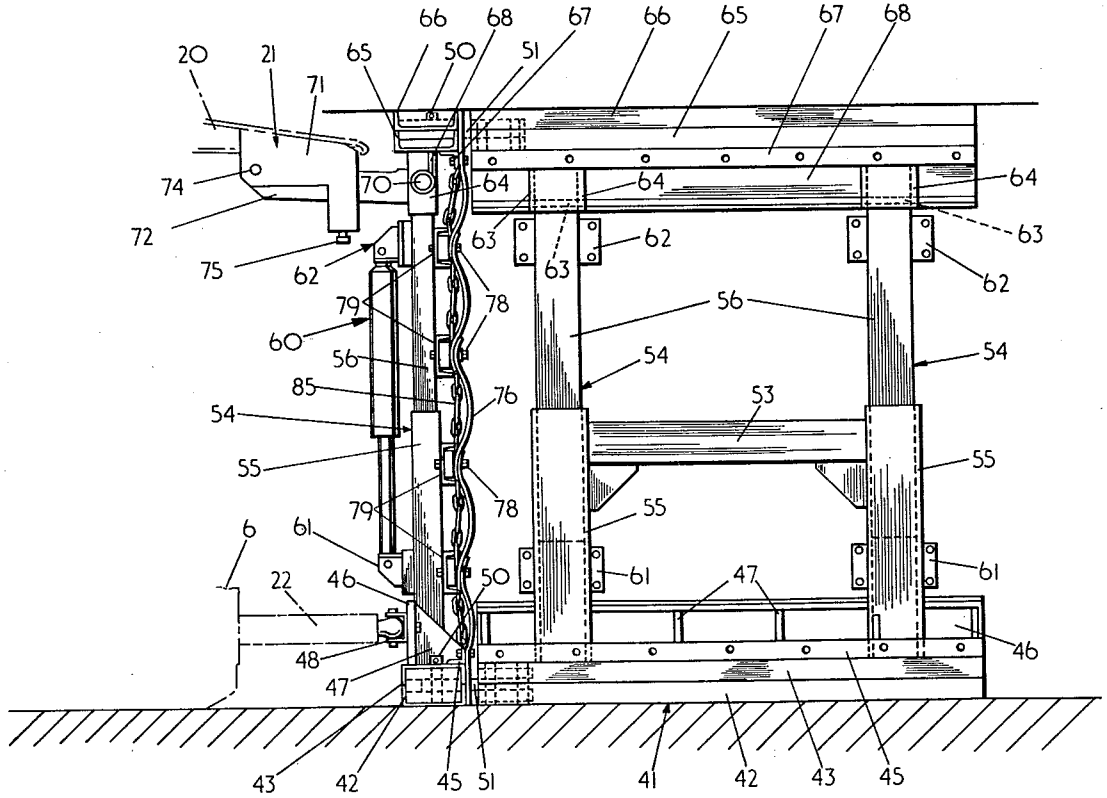
FIG. 4 is an incomplete end view of FIG. 2 looking in the direction of arrow Y.

From FIG. 4 it can be seen that the previously mentioned pivot bracket devices 21 provided on the rearwardly extending beams 20 engage cross rods 70 provided on the upper box-sectioned members 65, 66 of the section 40, each pivot bracket device 21 comprising a body 71 fixedly secured to the associated rearwardly extending beam 20 and a pivot arm 72 connected between the associated cross rod 70 and a pivot pin 74 on the body 71. The amount of downward pivotal movement of the arm relative to the body can be adjusted by a screw attachment 75 provided on the body. The function of the pivot bracket device 21 will be made clear later in this specification.

Each section 40, 41 of the shuttering also comprises a sheet 76 of flexible material, for example, conveyor belting, fixedly attached along its lower and upper edges to the previously mentioned inwardly directed brackets 45 and 67, respectively, and at intervals up each sheet 76 to attachment bolts 78 secured at intervals along horizontal trough-sectioned members 79 abutting the members 55, 56 of the telescopic guide arrangements 54. The horizontal members 79 are connected to adjacent horizontal members 79 and/or brackets 45, 67 by vertical chains (85) which limit the maximum spacing of the members 79 and brackets 67 to ensure the sheet material is never subjected to tension. For the sake of clarity one of the sheets 76 has been omitted from FIGS. 3 and 4.

In use, when the winning machine has won a strip of mineral from the working face 5 the conveyor 8 is advanced towards the newly exposed face followed by some of the beams 16 and props 17 and the roof supports 6 in sequence. As the roof supports 6 adjacent to the packing equipment 1 are advanced the rearwardly directed beams 20, 25 slide relative the remainder of a support.

Also the rams 22, 26 are actuated to advance the roof supports 6 relative to the packing equipment, the action of these rams ensuring the shuttering is kept in position retaining the pack material until set. As the roof supports are lowered from their roof supporting positions each bracket device 21 pivots about pin 70 allowing free vertical movement of the rearwardly extending beam 20.

When the previously formed pack 14 has set adequately to provide sufficient support to the mine roof the packing equipment 1 is advanced to define the next packhole 12 (as shown in FIG. 1).

In order to advance the packing equipment, the piston and cylinder devices 60 are retracted such that the roof engaging beams 65, 66 disengage the mine roof. Lowering of the roof engaging beams of the section 40 continues until the pivot lever arm 72 of the bracket device 21 abuts the screw adjustment device 75 which prevents further lowering of the released roof engaging beams 65, 66. Further retraction of the piston and cylinder arrangements 60 causes the base of the section 40 and the leading portion of the base of the section 41 to be raised from the mine floor. The horizontal ram 32 of the anchor chock 27 is released from the base of section 41. Thus, on simultaneous retraction of the rams 22 and the rams acting on the rearwardly extending beams 20 the packing equipment 1 is advanced towards the working face until a desired width of packhole 12 is defined. As the packing equipment advances the rearwardly extending beams 20 are slid forwards relative to the associated roof supports 6 by the previously mentioned rams (not shown).

Once the packing equipment is fully advanced the piston and cylinder arrangements 60 are extended until the bases of the sections 40, 41 contact the mine floor and the roof engaging beams contact the mine roof. The anchor chock 27 then is released from its roof supporting position and advanced towards the working face by the action of the ram 26. When the anchor chock 27 is fully advanced and reset to the mine roof the horizontal ram 32 is extended to abut the base of the section 41 to retain the shuttering in contact with the previously formed pack 14. The remaining wall of the pack nearest to the roadway 3 is then built up to the mine roof with bags containing broken rock or mineral. Upon completion of this retaining pack wall, flowable packing material is fed from the previously mentioned pipe line in the roadway into the packhole. This operation is continued until a pack is built extending up to the mine roof. This pack is then allowed to set before the shuttering is advanced further towards the working face.

From the above description it will be seen that the present invention provides packing equipment which is efficient in operation and which can be quickly and simply advanced. Packing equipment constructed as described is sufficiently flexible to accommodate slopes in the mine roof and/or mine floor and still provide adequate sealing against leakage of the flowable packing material. As the packing equipment is attached to the face roof supports it can be flexible to accommodate varying floor to roof heights and yet still provide sufficient resistance to retain flowable packing material until it sets.

I claim:

1. Mine packing equipment for retaining flowable packing material within a packhole comprising two connected sections for defining boundaries of the packhole, each section including a base, a roof engaging assembly for engaging the mine roof, a telescopic guide arrangement connected intermediate the base and the roof engaging assembly, a piston and cylinder device connected for controlling movement of the telescopic guide arrangement, and a flexible sheet interconnected along its upper and lower edges to the roof engaging assembly and the base, respectively.

2. Mine packing equipment as claimed in claim 1, wherein the two sections are pivotally connected to one another by pivot means.

3. Mine packing equipment as claimed in claim 2, wherein the two sections are pivotally connected to one another by pivot means mounted respectively on the bases and on the roof engaging assemblies of the two sections.

4. Mine packing equipment as claimed in claim 1, wherein each sheet is supported by vertically spaced horizontal members mounted on the associated telescopic guide arrangement.

5. Mine packing equipment as claimed in claim 4, wherein spaced horizontal members are interconnected by chains.

6. Mine packing equipment as claimed in claim 1 wherein bracket devices are provided on the base and on the roof engaging assembly for attaching the packing equipment to bases and roof beams of adjacent roof supports.

7. Mine packing equipment as claimed in claim 4, wherein bracket devices are provided on one of the sections for attaching the packing equipment to adjacent roof supports.

* * * * *